US006247967B1

(12) United States Patent
Wu et al.

(10) Patent No.: US 6,247,967 B1
(45) Date of Patent: Jun. 19, 2001

(54) SHIELDED ELECTRICAL CONNECTOR FOR IC CARD

(75) Inventors: Kun-Tsan Wu, Tu-Checn; Song-Rong Chiou, Taipei Hsien, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/207,084

(22) Filed: Dec. 7, 1998

(30) Foreign Application Priority Data

Dec. 5, 1997 (TW) ..... 86220161

(51) Int. Cl.[7] ..... H01R 13/648
(52) U.S. Cl. ..... 439/607
(58) Field of Search ..... 439/607, 608, 439/609, 610

(56) References Cited

U.S. PATENT DOCUMENTS 5,174,771 * 12/1992 Burgit et al. ..... 409/108
5,725,394 * 3/1998 Banakis et al. ..... 439/607
5,934,941 * 8/1999 Hirai et al. ..... 439/607
5,947,769 * 9/1999 Leonard et al. ..... 439/607

* cited by examiner

*Primary Examiner*—Kheim Nguyen
*Assistant Examiner*—Chandrika Prasad

(57) ABSTRACT

An electrical connector (1) for use with an electrical card comprises a dielectric housing (11) defining a plurality of passageways (114) each receiving a terminal (12) therein. A pair of supporting arms (14) extends from transverse ends of the housing (11). At least one of the arms (14) defines a retaining recess (141, 24*a*, 34*a*, 44*a*) therein. An EMI shield (13) covers at least a portion of the terminals (12) and includes a base plate (131). At least a retainer (133, 233, 333, 433) is integrally formed on a portion of the base plate (131) for detachably and resiliently engaging with the corresponding retaining recess (141, 24*a*, 34*a*, 44*a*) of the supporting arm (14) of the housing (11).

3 Claims, 15 Drawing Sheets

32

SHIELDED ELECTRICAL CONNECTOR FOR IC CARD

FIELD OF THE INVENTION

The present invention relates to an electrical connector, and more particularly to a shielded electrical connector for connection to an IC (Integrated Circuit) card having supporting arm extending from transverse ends of a dielectric housing thereof for providing a substantial support to an EMI shield mounted thereon.

DESCRIPTION OF PRIOR ART

Almost each connector is provided with an EMI shield to improve noiseless signal communication thereof. In the very beginning, the EMI shield is integrally molded with a dielectric housing. For example, U.S. Pat. Nos. 5,333,100, 5,505,628, 5,572,408, and 5,586,893 disclose such configuration. However, this has a shortcoming since the EMI shield is fixedly molded onto the housing. Once an assembled pin is damaged or mis-aligned, it is hard to find an access to modify the damaged pin.

U.S. Pat. Nos. 5,490,043 and 5,590,028 disclose a grounding clip attached to a dielectric housing. The grounding clip is then connected with a metal housing to establish a grounding path. U.S. Pat. Nos. 5,330,360 and 5,683,181 disclose a grounding tab extending from a side of a metal housing for establishing a grounding path with a printed circuit board. However, the formation of the grounding clip and the grounding tab needs a plurality of processes of stamping, forming and bending. This is really not suitable for mass production.

U.S. Pat. No. 5,478,260 discloses a ground plate 80 that is attached to a housing 76 of a connector 74 by a side portion 88. However, a plate like portion 82 is easy to be bent because of external force. On the other hand, the attachment of the plate like portion 82 to the housing 76 is not secured also.

SUMMARY OF THE INVENTION

An objective of this invention is to provide a dielectric housing having a pair of supporting arms outwardly extending from transverse ends thereof thereby a front edge of an EMI shield can be firmly supported.

Another objective of this invention is to provide a dielectric housing having a pair of supporting arms in which a retaining recess is provided for receiving a retainer of the EMI shield.

In order to achieve the objectives set forth, an electrical connector in accordance with the present invention generally comprises a dielectric housing defining a plurality of passageways therethrough and each receiving a terminal therein. Each terminal includes a soldering leg extending outward from each passageway. A pair of supporting arms extend from transverse ends of the housing thereof and each arm defines a retaining recess thereon. An EMI shield for shielding the terminals includes a base plate and a flap portion extending from an edge of the base plate. A plurality of spring fingers extend from a side of the flap portion. A pair of retainers extend from transversal ends of the flap portion for detachably engaging with the retaining recess of the supporting arm.

In a preferred embodiment, at least a retaining barb is formed on an edge of the base portion opposite the flap portion. The retaining barb may insert into a notch formed on a dam portion of the housing.

These and additional objectives, features, and advantages of the present invention will become apparent after reading the following detailed description of the preferred embodiments of the invention taken in conjunction with the appended drawing figures.

DETAILED DESCRIPTION OF PREFERRED EMBODIMENT

Figure 1:
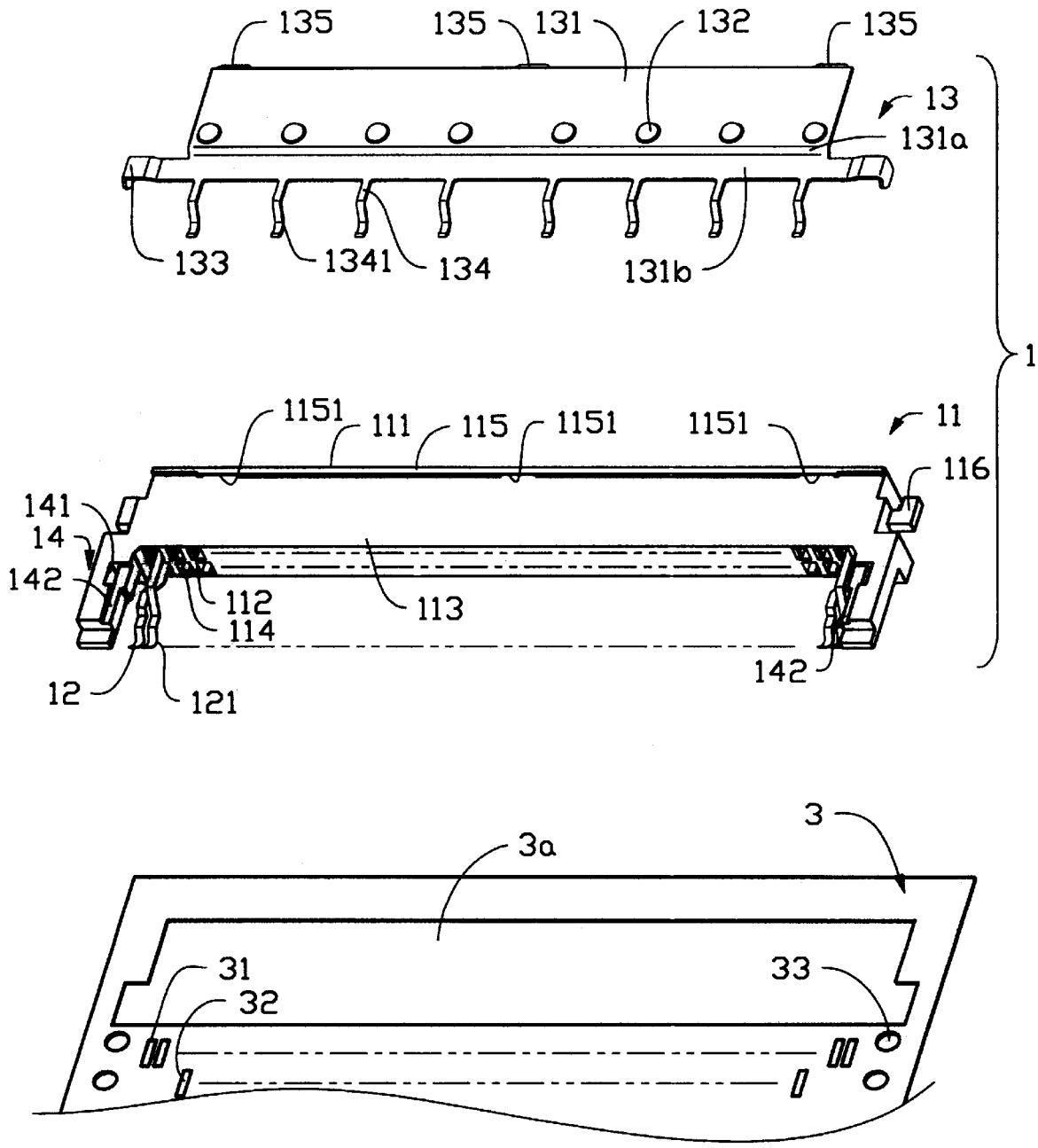
FIG. 1 is an exploded perspective view of an electrical connector in accordance with the present invention.

Referring to FIG. 1, an electrical connector 1 in accordance with the present invention comprises a dielectric housing 11 defining a plurality of passageways 114 extending from a mating face 111 to a rear face 112. Each passageway 114 receives a terminal 12 having a soldering leg 121 thereof. A dam portion 115 is integrally formed on an edge of an upper face 113 and defines three retaining notches 1151 spaced from each other. A pair of supporting arms 14 extend from transverse ends of the housing 11. Each supporting arm 14 defines a retaining recess 141 thereon. A recessed platform 142 is defined adjacent to the retaining recess 141. The housing 11 further forms two supporting wedges 116 on transverse sides thereof.

An EMI shield or grounding device 13 includes a base plate 131. An edge of the base plate 131 is formed with three retaining barb 135 with respect to the corresponding retaining notch 1151. The base plate 131 further includes eight (8) projections 132 directed upward. A transition portion 131*a* extends outward and downward from another edge of the base plate 131. By the provision of the transition portion 131*a*, the rigidity along a longitudinal axis of the base plate 131 can be further increased. A flap portion 131*b* extends from an edge of the transition portion 131*a*. The flap portion 131*b* is arranged in parallel to the base plate 131. Eight spring fingers 134 extend horizontally from an edge of the flap portion 131*b*. Each spring finger 134 forms a soldering leg 1341 for engaging with a grounding pad 32 of a printed circuit board 3. Two retainers 133 extend from transverse ends of the flap portion 131*b*. Each retainer 133 includes an arm 133*a*, a raised plateau 133*b*, and a hook 133*c* extending downward from an end of the raised plateau 133*b* (See FIG. 2). The hook 133*c* can be securely retained within the retaining recess 141 of the supporting arm 14. The housing 11 together with the EMI shield 13 can be mounted to a printed circuit board 3. The printed circuit board 3 defines an opening 3*a* to receive the housing 11 therein. The printed circuit board 3 is integrally formed with a plurality of conductive pads 31 corresponding to soldering legs 121 of the terminals 12, and eight grounding pads 32 corresponding to the soldering legs 1341 of the spring fingers 134. The printed circuit board 3 further includes a dowel hole 33 corresponding to a dowel pin 143 of the supporting arm 14 (FIG. 4A).

Figure 2:
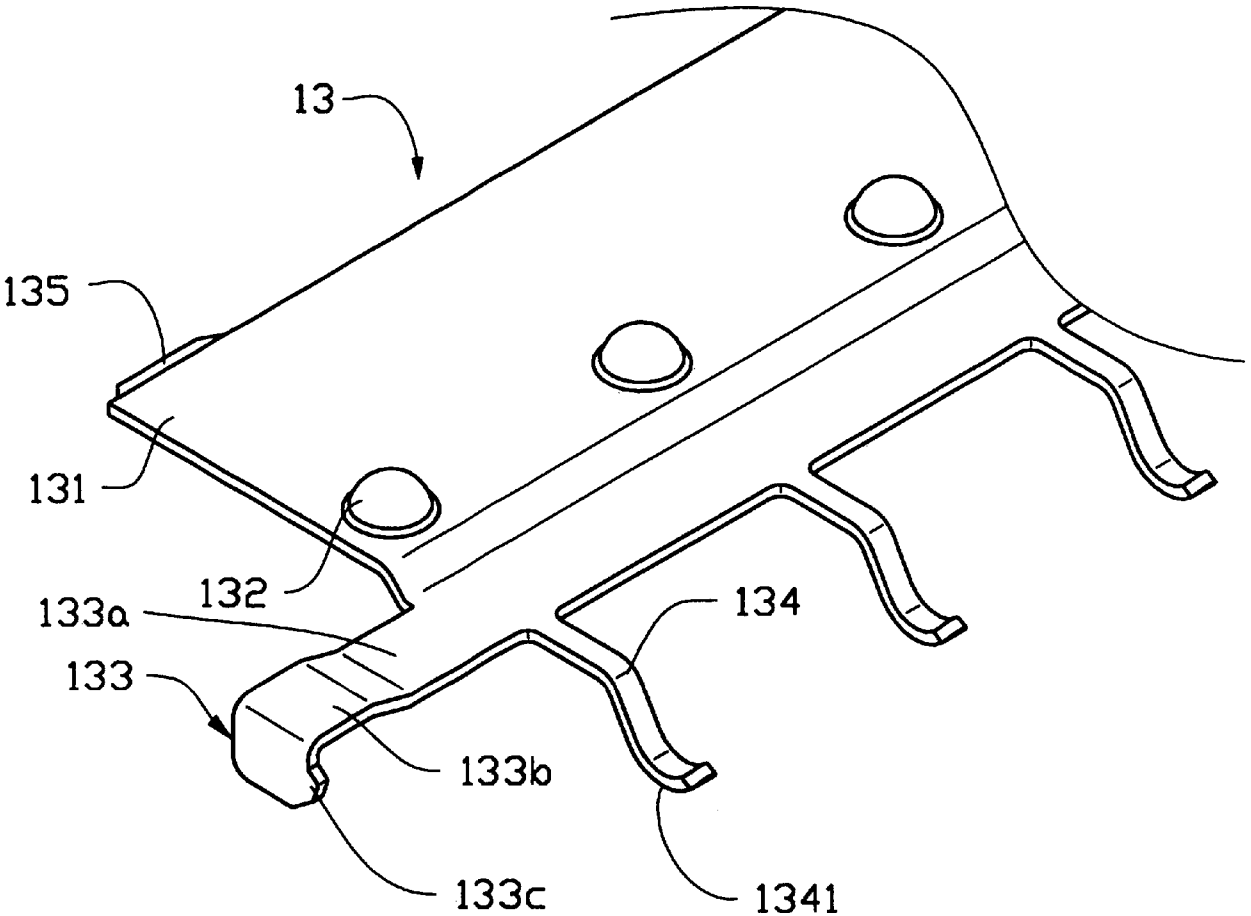
FIG. 2 is a partial, perspective view of an EMI shield shown in FIG. 1.

FIG. 2 is an enlarged, partial view of the EMI shield 13.

Figure 3A:
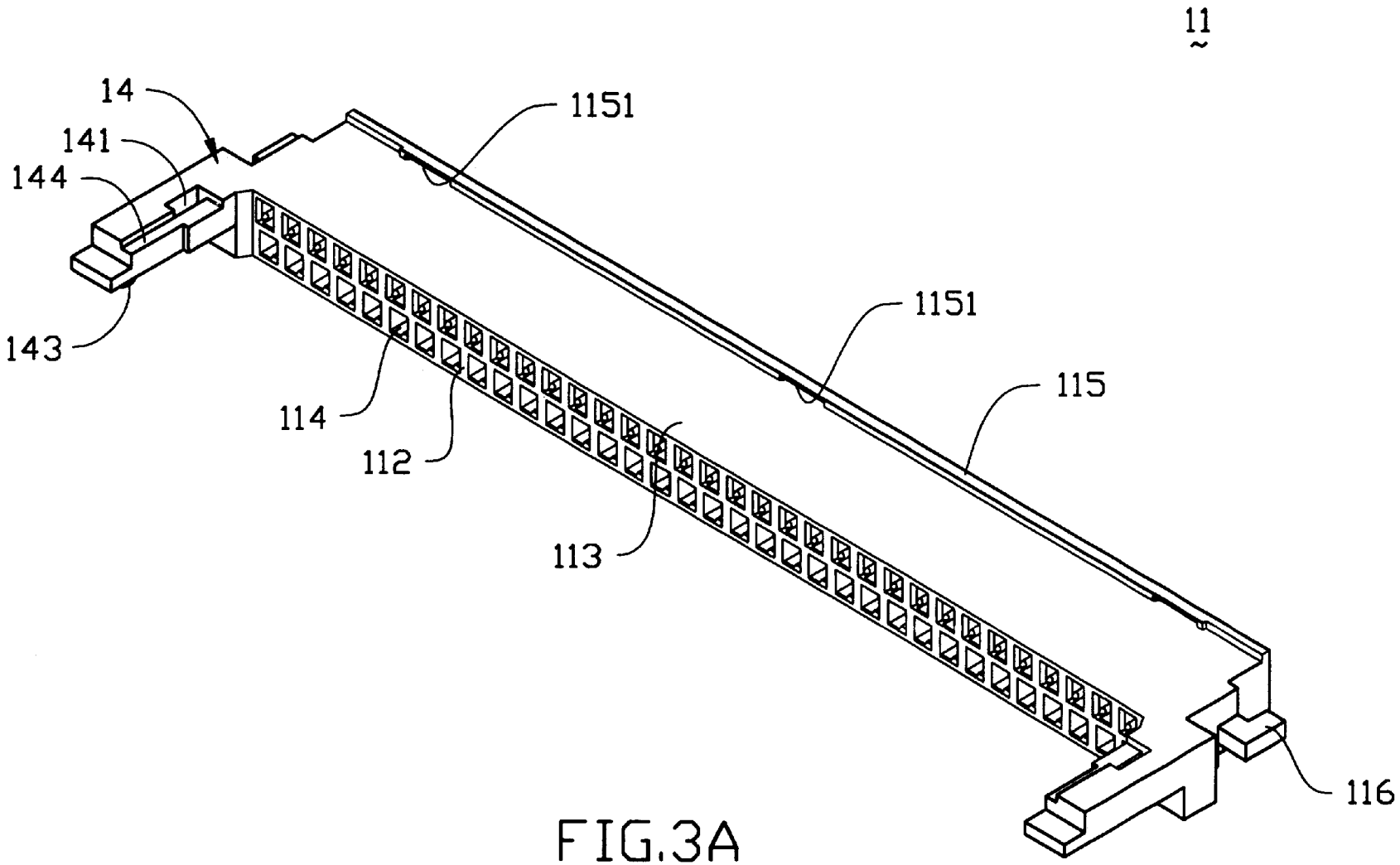
FIG. 3A is a perspective view of a dielectric housing shown in FIG. 1.

FIG. 3A is a perspective view of the housing 11 of FIG. 1.

Figure 3B:
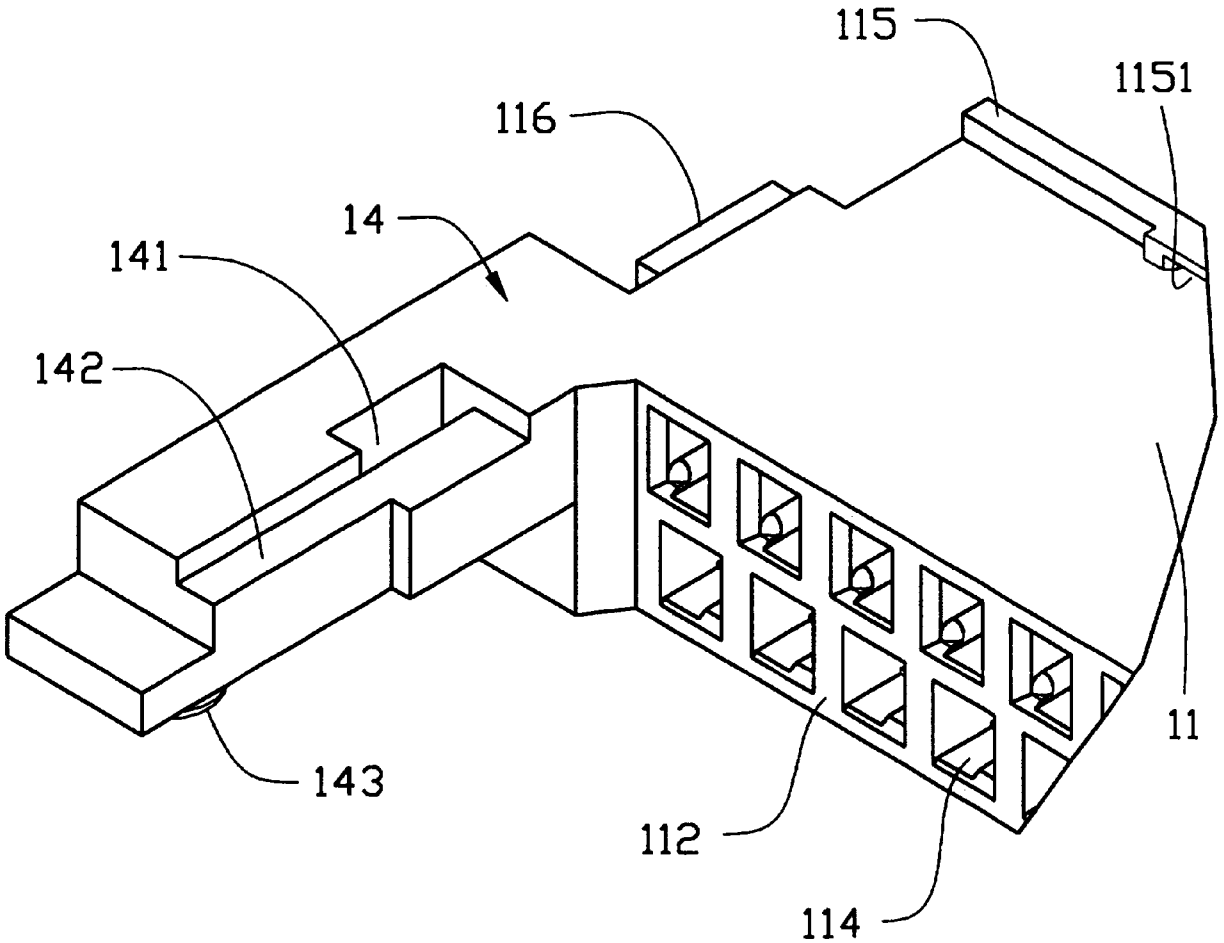
FIG. 3B is an enlarged view of a supporting arm of the dielectric housing of FIG. 3A.

FIG. 3B is an enlarged, partial view of the housing 11.

FIG. 4A is a partial, bottom view of the housing 11 in which the dowel pin 143 is clearly shown.

Figure 4B:
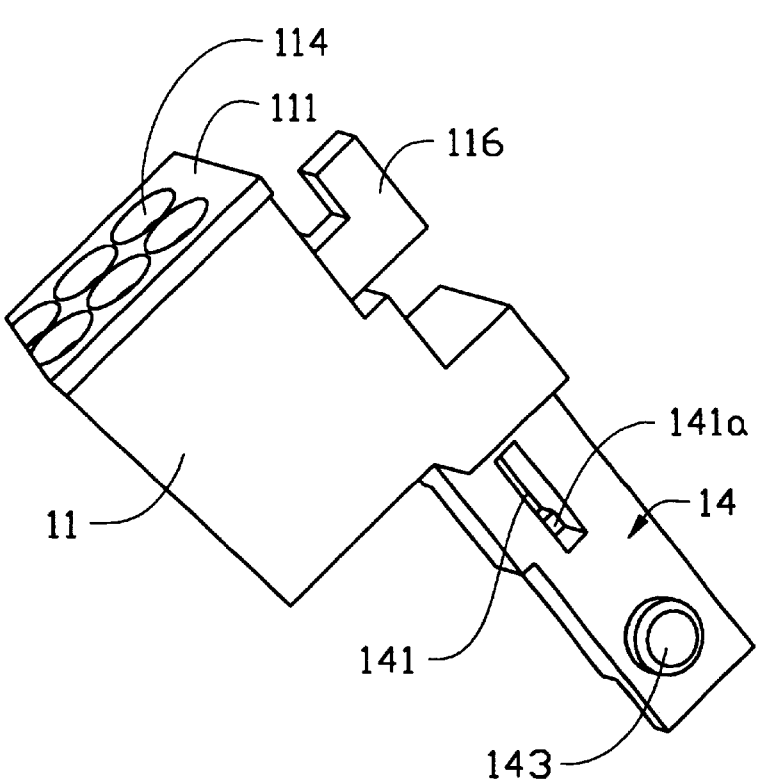
FIG. 4B is a perspective view of the supporting arm viewed from different angle.
Figure 4A:
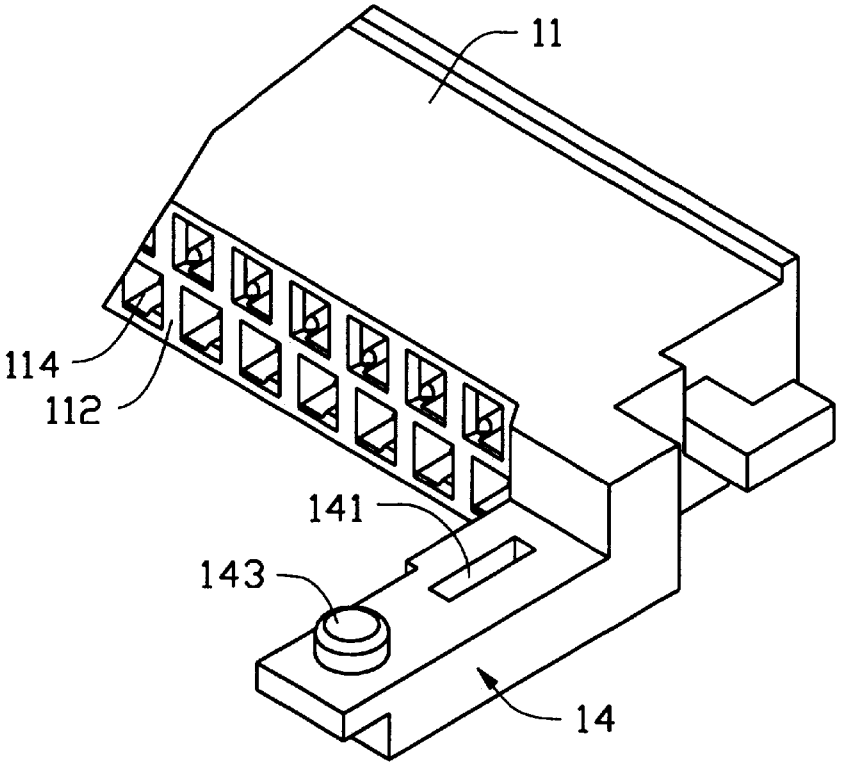
FIG. 4A is a bottom, perspective view of the supporting arm of the dielectric housing of FIG. 3B.

FIG. 4B is still a partial, bottom view of the housing 11 in which a lock 141*a* within the retaining recess 141 is shown. When the hook 133*c* inserts into the retaining recess 141, the hook 133*c* may engage with the lock 141*a* thereby the EMI shield 13 is securely mounted onto the upper face 113 of the housing 11.

Figure 5A:
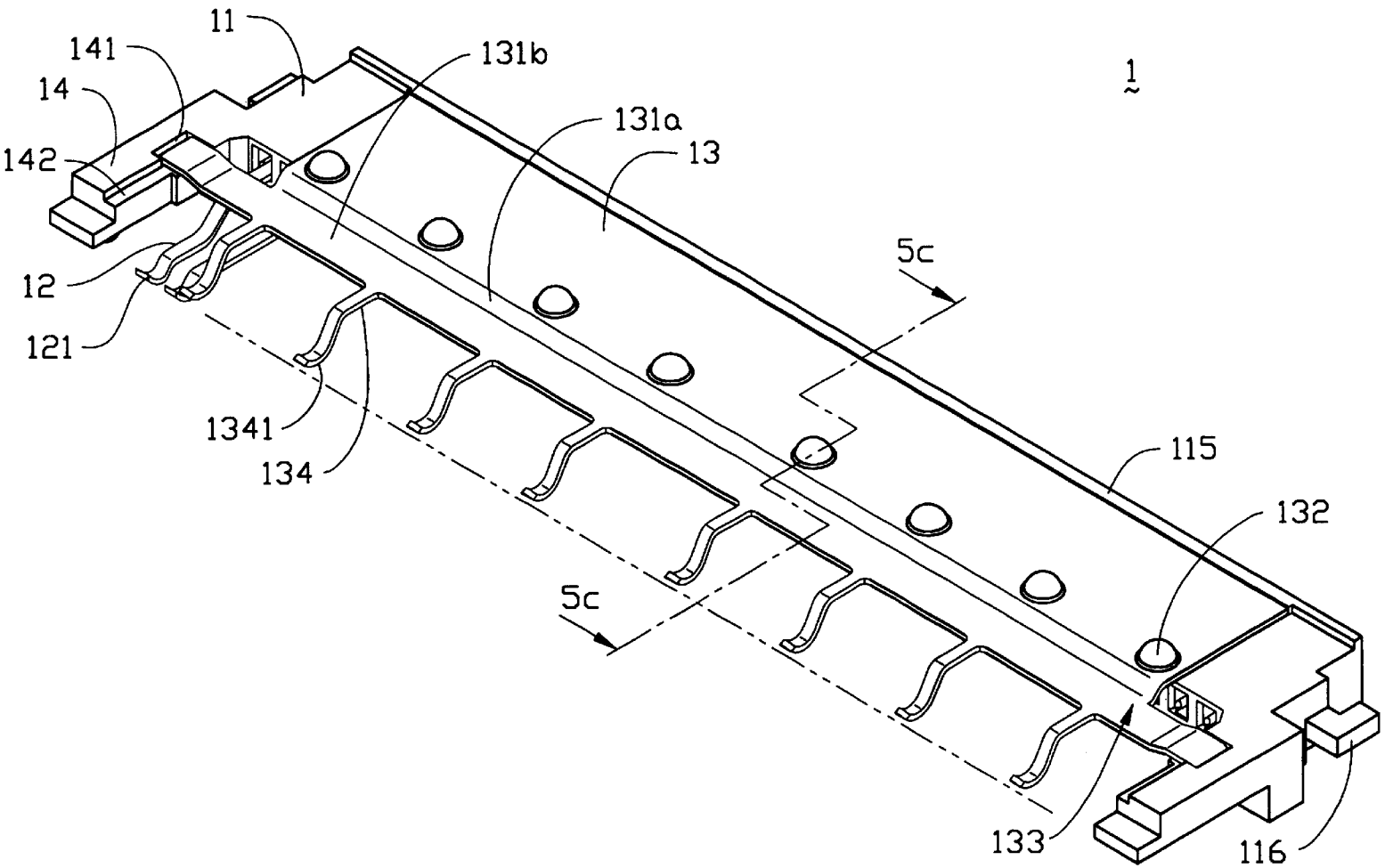
FIG. 5A is an assembled perspective view of the electrical connector shown in FIG. 1.

FIG. 5A is an assembled view of the electrical connector 1. After the EMI shield 13 is securely attached to the housing 11, the soldering leg 1341 of the spring finger 134 is coplanar with the soldering legs 121 of the terminals 12.

Figure 5B:
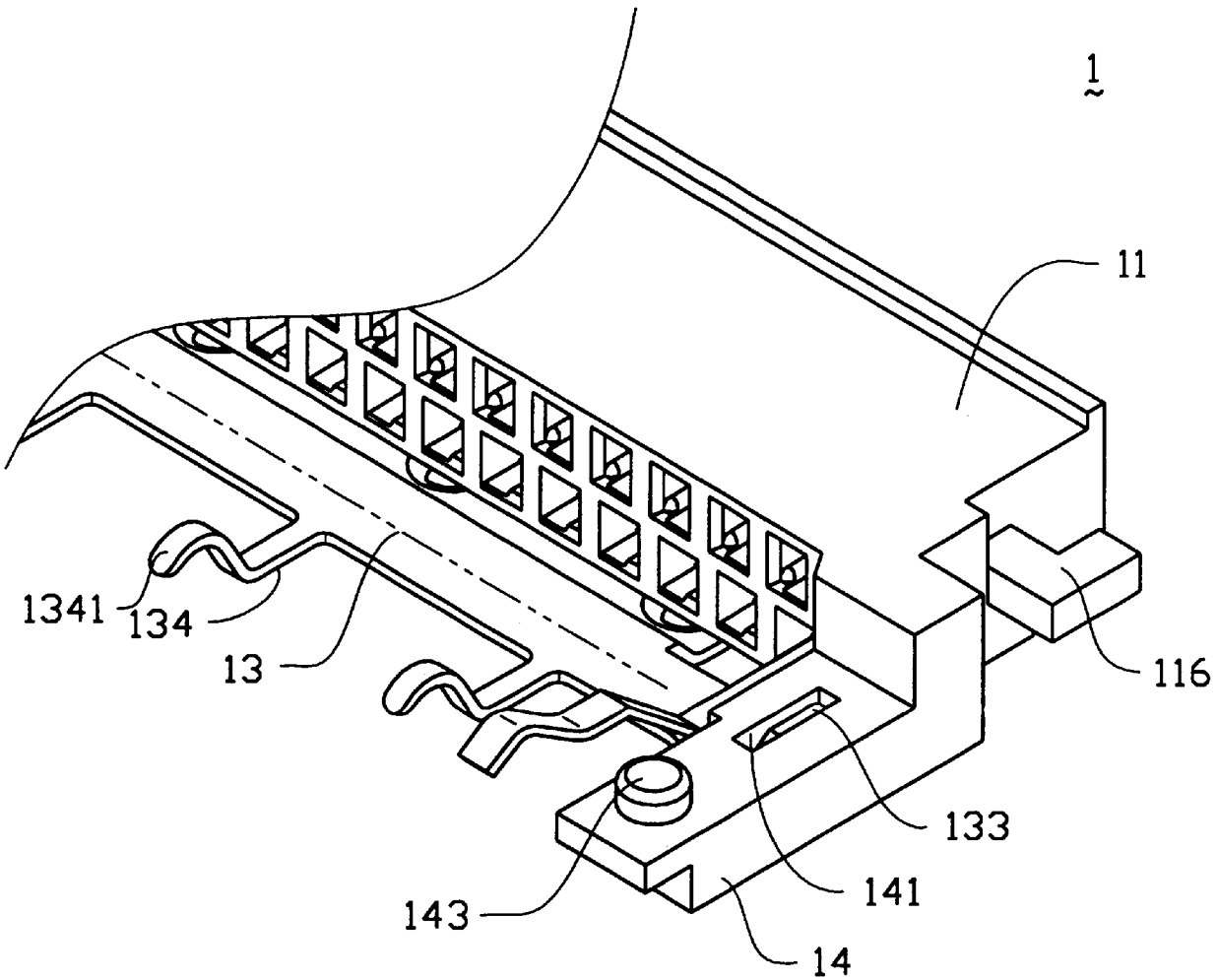
FIG. 5B is a partial, bottom view of the electrical connector shown in FIG. 5A.

FIG. 5B is a partial, bottom view of the electrical connector 1 of FIG. 5A.

Figure 5C:
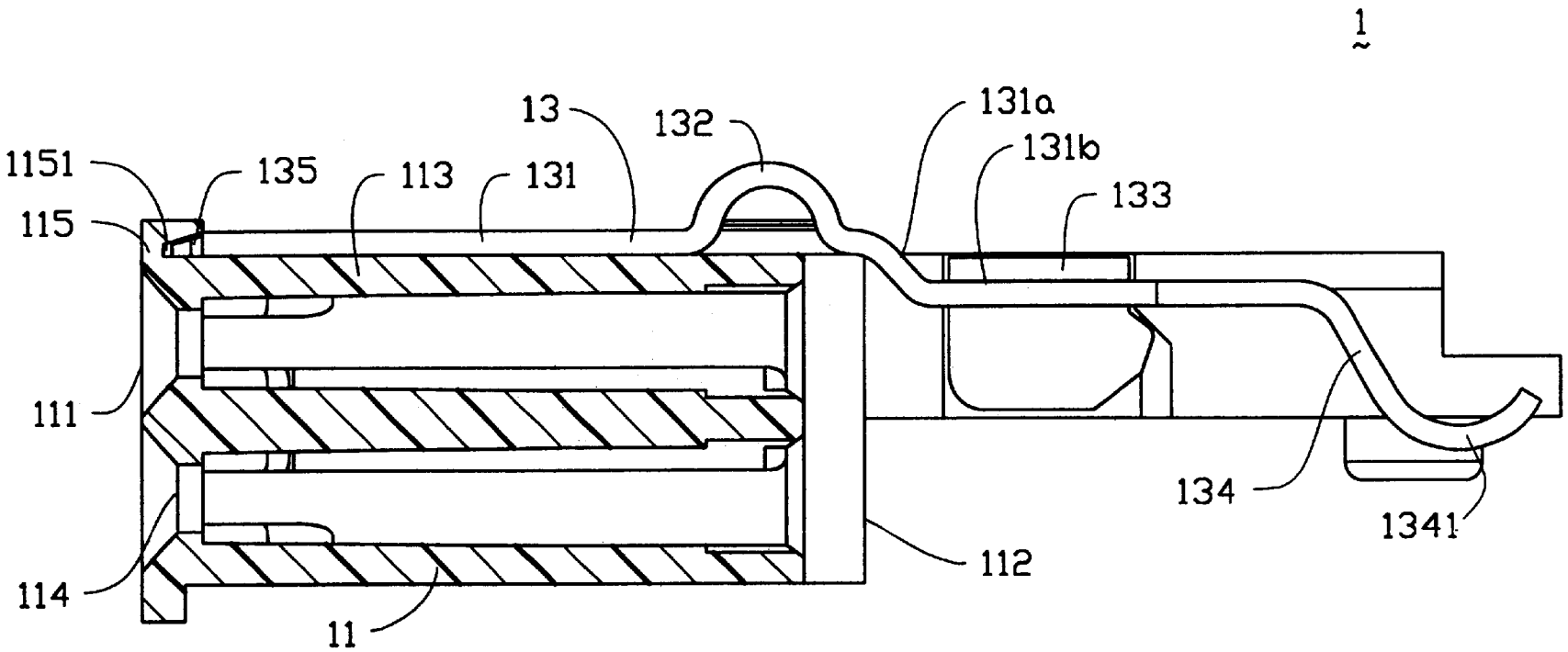
FIG. 5C is a cross sectional view of the electrical connector taken from line 5C—5C of FIG. 5A.

FIG. 5C is a cross sectional view of the electrical connector 1 taken along line 5C—5C of FIG. 5A. It can be readily seen that the soldering leg 1341 of the spring finger 134 and the soldering leg 121 of the terminal 12 are coplanar.

Figure 6:
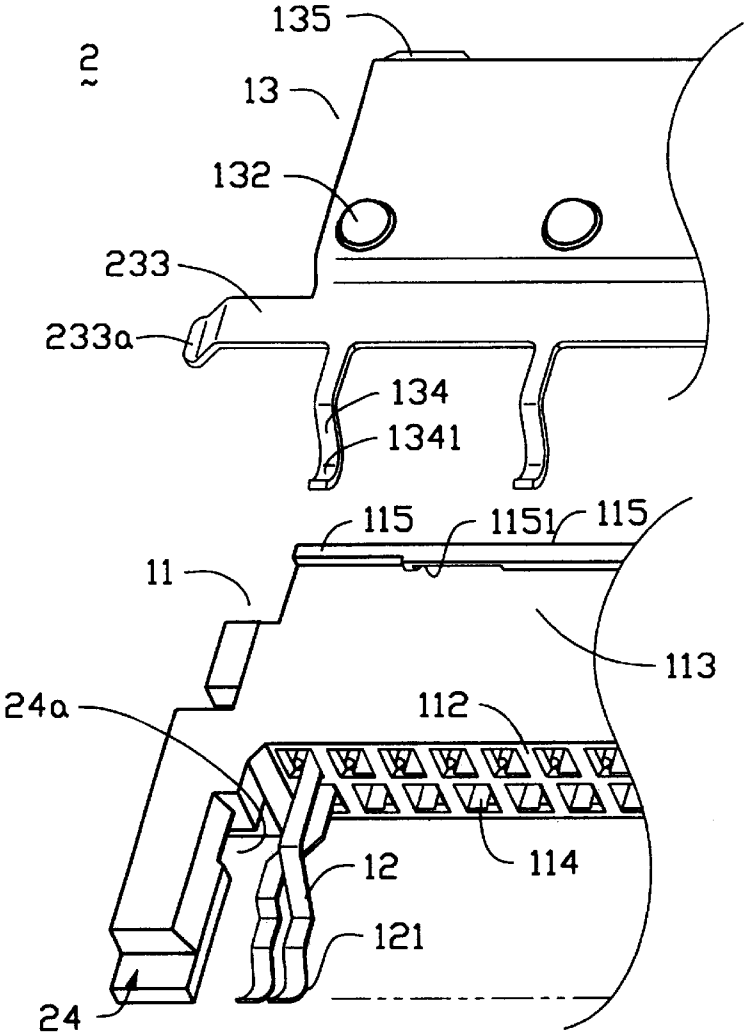
FIG. 6 is an exploded, perspective view of a second embodiment of an electrical connector in accordance with the present invention.

FIG. 6 is a partial, perspective view of a second embodiment of an electrical connector 2 having a modified retainer 233. The retainer 233 includes merely an extension 233*a* which can insert into a recess 24*a* of the supporting arm 24.

Figure 7:
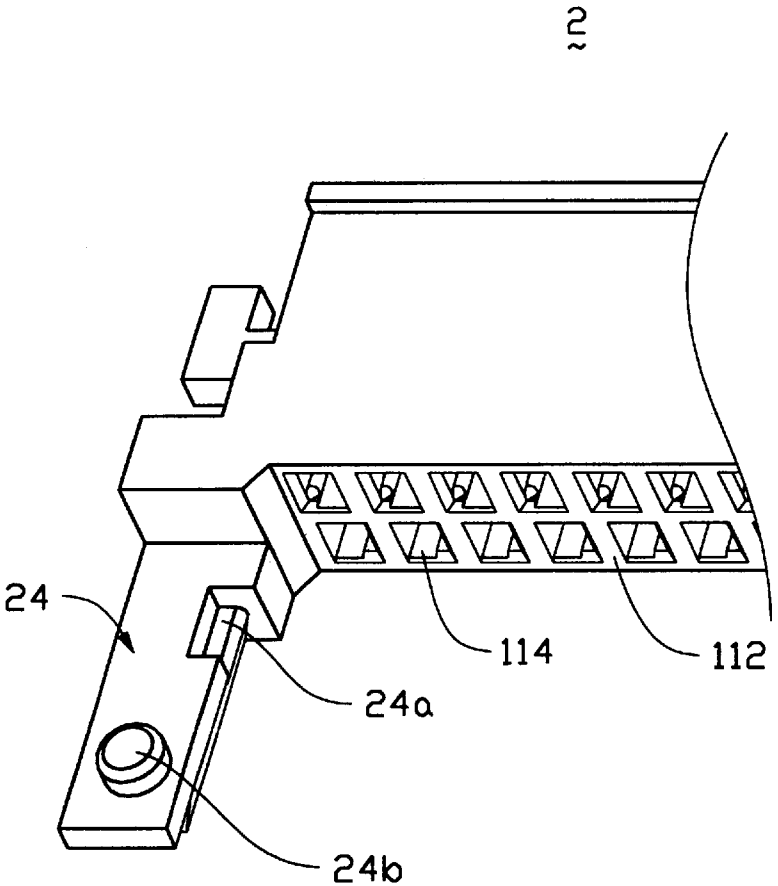
FIG. 7 is a partial, perspective view of a dielectric housing of FIG. 6.

FIG. 7 is a bottom view of the supporting arm 24 showing a dowel pin 24*b* thereon.

Figure 8:
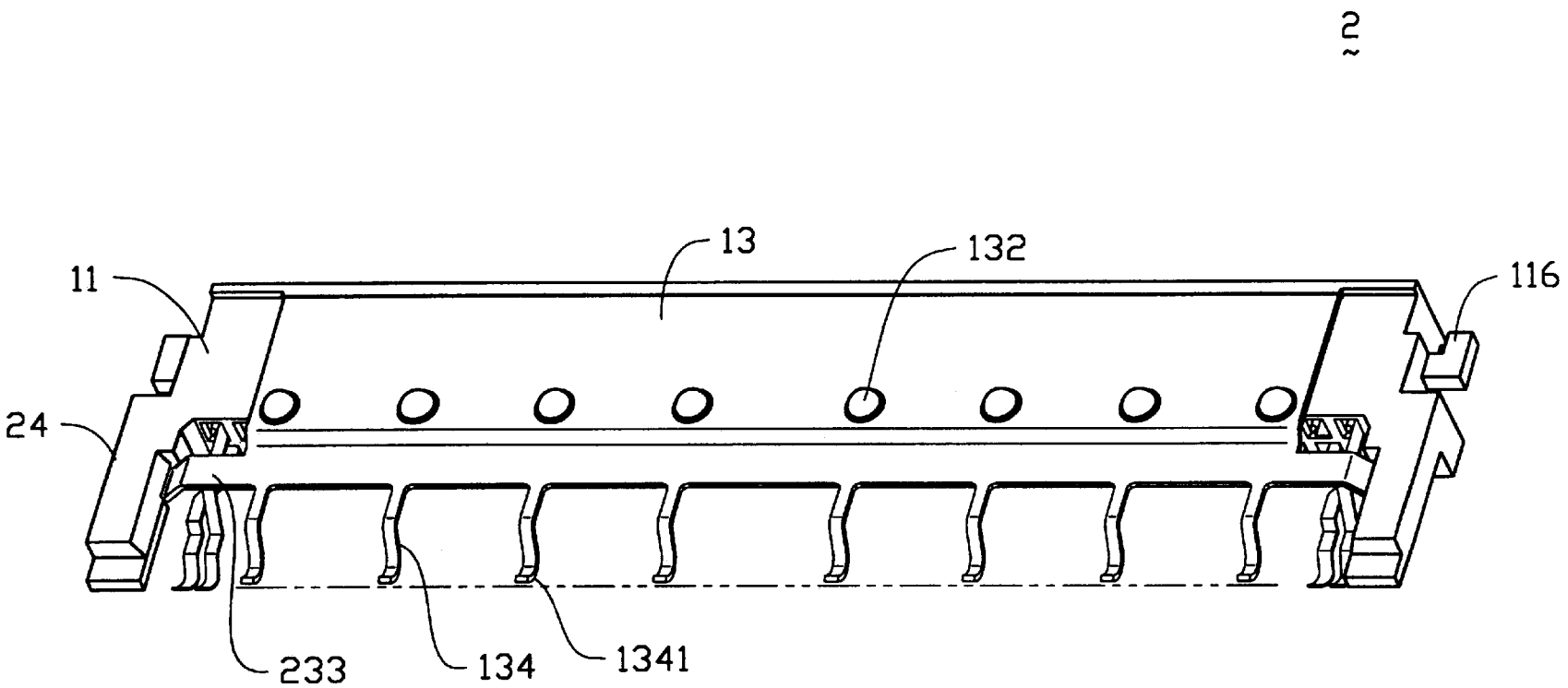
FIG. 8 is an assembled view of the electrical connector of FIG. 6.

FIG. 8 is a perspective view of the electrical connector 2 in which the EMI shield 13 is attached to the housing 11.

Figure 9A:
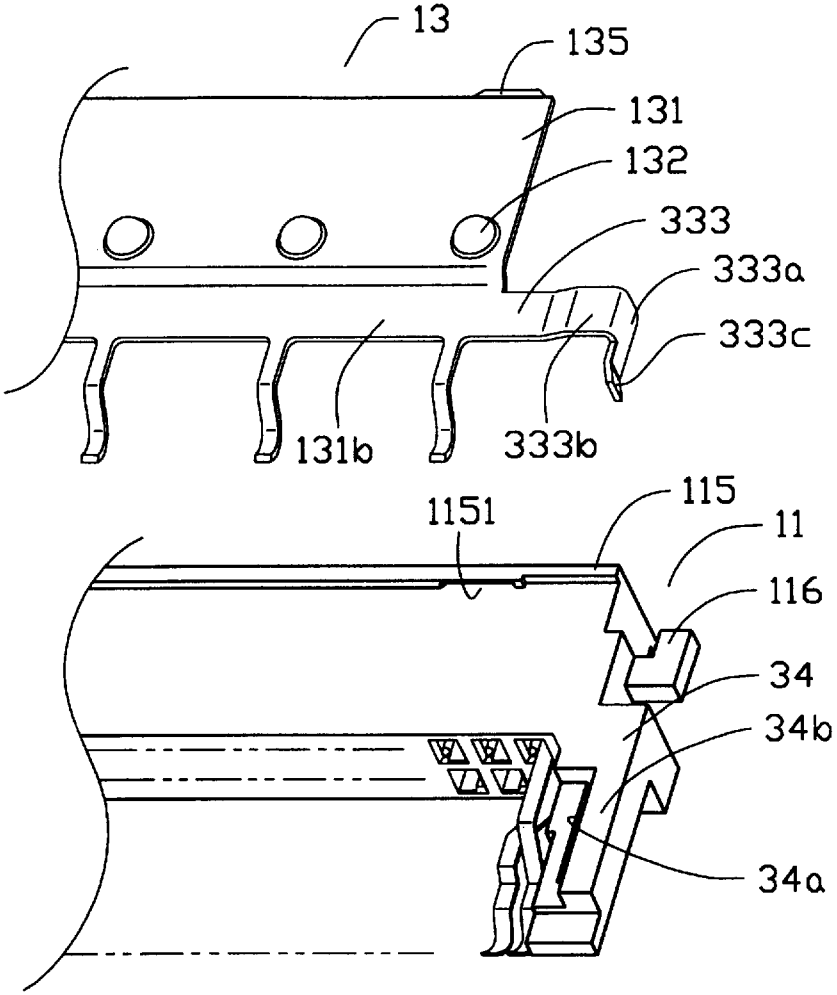
FIG. 9A is a partial, exploded perspective view of an electrical connector in accordance with a third embodiment of the present invention.
Figure 9B:
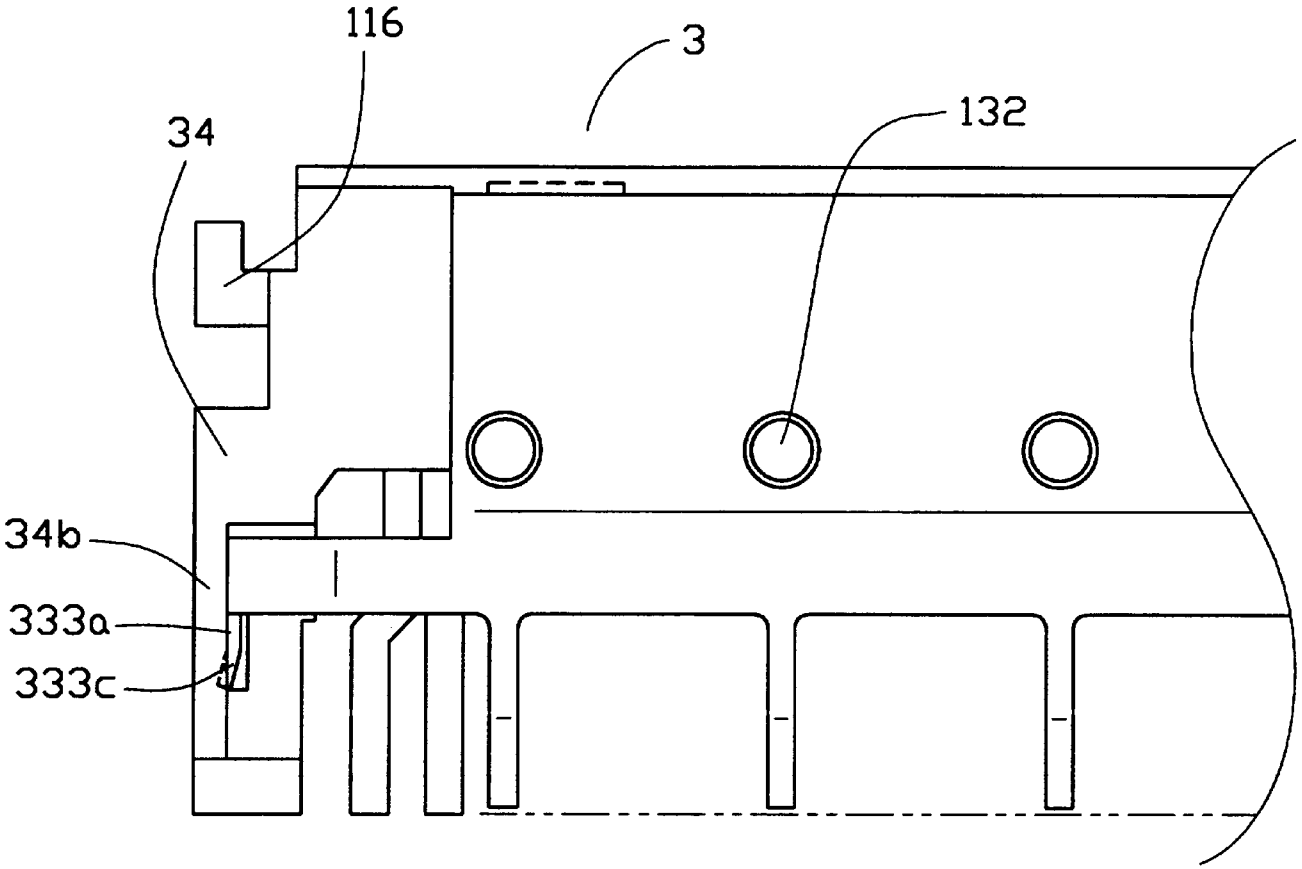
FIG. 9B is a partial, top plan view of the assembled electrical connector of FIG. 9A.

FIG. 9A is an exploded, perspective view of an electrical connector 3 having a third embodiment of a retainer 333 and a supporting arm 34. The retainer 333 includes a tab 333*a* extending downward from an extension 333*b*. A biasing fin 333*c* is formed on an end of the tab 333*a* and is oriented in an angle from the tab 333*a*. The supporting arm 34 includes a retaining recess 34*a* and a biasing beam 34*b* is disposed thereon. Referring to FIG. 9B, when the EMI shield 13 is attached to the housing 11, the biasing fin 333*c* is pressed inward to slip over the biasing beam 34*b*. After the tab 333*a* is seated, the biasing fin 333*c* will bounce back and seat right under the biasing beam 34*b*. By this arrangement, the EMI shield 13 is securely attached to the housing 11.

Figure 10A:
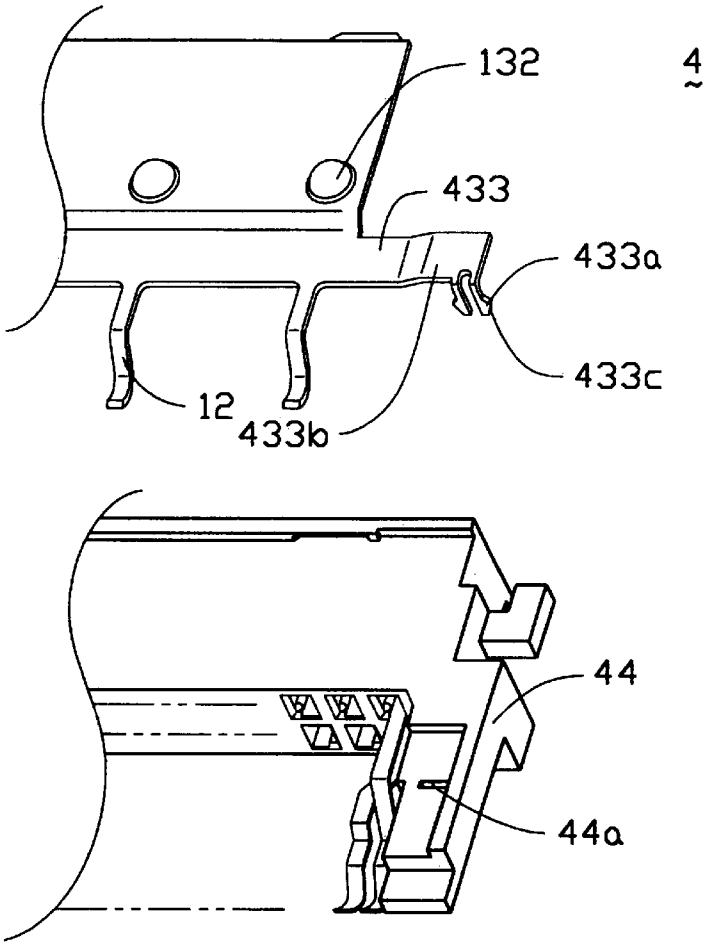
FIG. 10A is a partial, exploded perspective view of an electrical connector in accordance with a fourth embodiment of the present invention.
Figure 10B:
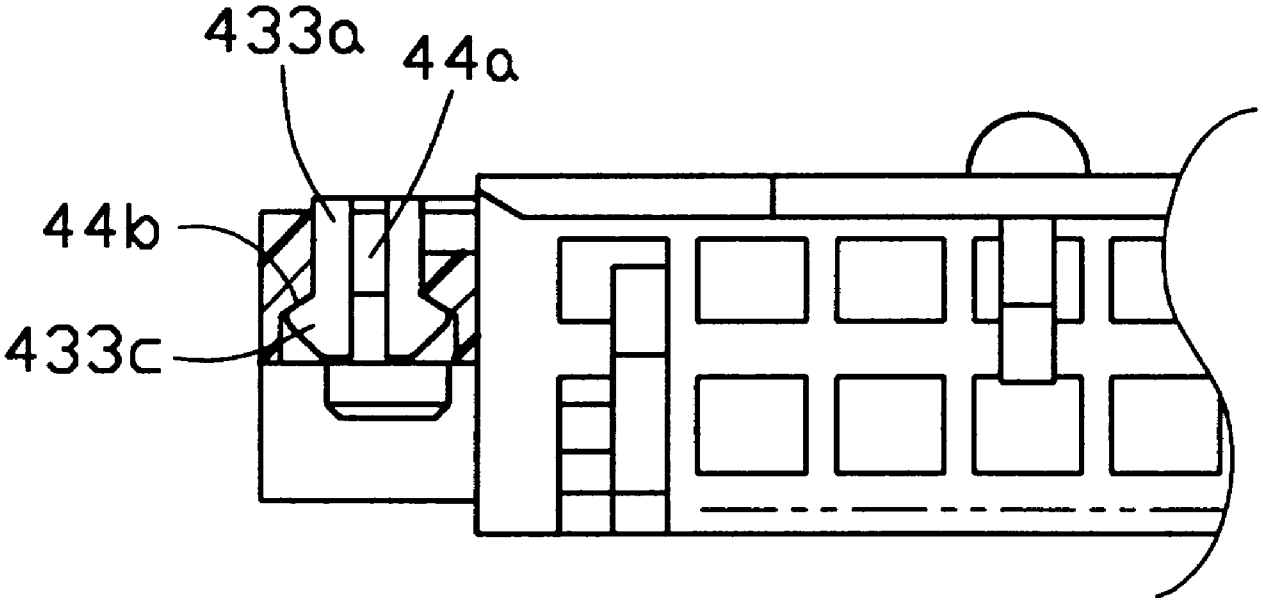
FIG. 10B is a partially cross-sectional view of the assembled electrical connector of FIG. 10A.

FIG. 10A is a partial, exploded perspective view of an electrical connector 4 having a fourth embodiment of a retainer 433 and a supporting arm 44. In this embodiment, a pair of mounting legs 433*a* extend downward from an extension 433*b*. Each mounting leg 433*a* forms a barb 433*c* directed outward. A supporting arm 44 includes a rectangular mounting hole 44*a* for receiving the mounting legs 433*a*. When the EMI shield 13 is attached to the housing 11, as shown in FIG. 10B, the mounting legs 433*a* are inserted into the mounting hole 44*a* such that the barb 433*c* abuts against a shoulder 44*b* of the hole 44*a*. By this arrangement, the ESI shield 13 is securely attached to the housing 11.

It can be seen that the EMI shield has the retaining barbs on the front portion for engagement with the corresponding notches of the housing so as to restrain the vertical movement thereof with regard to the housing while further has the retainers for engagement with the corresponding recesses/holes in the housing so as to restrain the horizontal movement thereof with regard to the housing. Therefore, through these two restraints, the shield may be securely attached to the housing wherein the base plate abuts against the top surface of the housing.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector for use with an electrical card, comprising:

a dielectric housing defining a plurality of passageways each receiving a terminal therein and a pair of supporting arms extending from lateral ends of said housing, at least one of said arms having a retaining recess defined therein and a biasing beam disposed on the retaining recess with a portion of the retaining recess upwardly exposed, the biasing beam extending along the length of the retaining recess; and an EMI shield attached to the housing shielding at least a portion of said terminals and including a base plate, at least a retainer integrally formed with said base plate and including a downwardly extending tab and a biasing fin extending rearward from an end of the tab at an obtuse angle, the retainer resiliently and detachably engaging with said corresponding retaining recess of said supporting arm of said housing with the tab thereof retained in the exposed portion of the retaining recess and with the biasing fin thereof resiliently received in the retaining recess and laterally exposed right under the biasing beam.

2. The electrical connector as recited in claim 1, wherein said base plate includes at least a retaining barb detachably engaging with a retaining notch defined in a dam portion formed on an upper surface of said housing.

3. The electrical connector as recited in claim 1, wherein a flap portion extends from an edge of said base plate, and said retainer is integrally formed on an end of said portion.

* * * * *